US009263812B2

(12) United States Patent
Ishimaru

(10) Patent No.: US 9,263,812 B2
(45) Date of Patent: Feb. 16, 2016

(54) ELECTRICAL CONNECTOR

(71) Applicant: DAI-ICHI SEIKO CO., LTD., Kyoto-shi (JP)

(72) Inventor: Masao Ishimaru, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/204,390

(22) Filed: Mar. 11, 2014

(65) Prior Publication Data

US 2014/0273597 A1 Sep. 18, 2014

(30) Foreign Application Priority Data

Mar. 13, 2013 (JP) ..... 2013-050334

(51) Int. Cl.

*H01R 13/62* (2006.01)
*H01R 12/70* (2011.01)
*H01R 12/77* (2011.01)

(52) U.S. Cl.

CPC ..... *H01R 12/7029* (2013.01); *H01R 12/774* (2013.01)

(58) Field of Classification Search

CPC .. H01R 12/592; H01R 12/79; H01R 13/6275; H01R 13/684
USPC ..... 439/494, 458, 450, 260, 325, 328
See application file for complete search history.

(56) References Cited

U.S. PATENT DOCUMENTS 8,002,567 B2 * 8/2011 Hara ..... H01R 12/79 439/329
8,678,844 B2 * 3/2014 Yoshisuji ..... H01R 12/592 439/260
8,851,918 B2 * 10/2014 Yoshisuji ..... H01R 13/639 439/260
2012/0238125 A1 * 9/2012 Yoshisuji et al. .... H01R 12/592 439/350

FOREIGN PATENT DOCUMENTS

| | | | |
|---|---|---|---|
| CN | 1409443 | A | 4/2003 |
| CN | 101150234 | A | 3/2008 |
| CN | 101222093 | A | 7/2008 |
| JP | 2011-108500 | | 6/2011 |
| JP | 2011-108501 | | 6/2011 |
| JP | 2012-169099 | A | 9/2012 |
| JP | 2012-199187 | A | 10/2012 |
| TW | 201223015 | A | 6/2012 |

OTHER PUBLICATIONS

Office Action for CN201410089738.X, issued Dec. 2, 2015 (no English translation provided).

* cited by examiner

*Primary Examiner* — Abdullah Riyami
*Assistant Examiner* — Thang Nguyen
(74) *Attorney, Agent, or Firm* — Oblon, McClelland, Maier & Neustadt, L.L.P.

(57) ABSTRACT

A lock-arm regulating part, which carries out regulation so that a latch lock claw for carrying out specified movement so as to be engaged with or detached from a signal transmission medium inserted in an insulating housing does not carry out non-constant movement different from the specified movement, is provided. The lock-arm regulating part is disposed to be opposed to the lock arm member in two directions including an insertion/removal direction of the signal transmission medium and an insertion/removal orthogonal direction. Since this configuration is employed, when non-constant external force such as pulling force in a direction different from the original insertion/removal direction is applied to the signal transmission medium, part of the lock arm member is configured to abut the lock-arm regulating part and prevent non-constant movement of the latch lock claw.

5 Claims, 13 Drawing Sheets

ELECTRICAL CONNECTOR

BACKGROUND OF THE INVENTION

1. Field of the Invention

The present invention relates to an electrical connector configured to retain a signal transmission medium when a latch lock claw is engaged with the signal transmission medium inserted in an insulating housing.

2. Description of Related Art

Generally, in various electric devices, etc., as means for electrically connecting various signal transmission media such as flexible printed circuits (FPC) and flexible flat cables (FFC), various electrical connectors are widely used. For example, as electrical connectors used by being mounted on printed wiring boards like Japanese Patent Application Laid Open No. 2011-108500 and Japanese Patent Application Laid Open No. 2011-108501, those employing a so-called one-action auto-lock mechanism have been recently used. In such a lock mechanism, a latch lock claw elastically displaceably supported by a lock arm member is placed on the surface of the signal transmission medium comprised of a FPC, FFC, or the like inserted in a front-end-side opening of the insulating housing (insulator) and is displaced; and, then, engagement is carried out so that part of the latch lock claw is dropped in an engagement part of the signal transmission medium. When the electrical connector provided with the one-action auto-lock mechanism having this configuration is used, the signal transmission medium is retained in an approximately it mobile state only by inserting the signal transmission medium to a predetermined position in the electrical connector, and work efficiency is improved.

As described above, the electrical connector provided with the one-action auto-lock mechanism has an advantage that lock is carried out only by inserting the signal transmission medium (FPC, FFC, or the like) in the electrical connector. However, if external force is applied in a non-constant direction, for example, if the signal transmission medium (FPC, FFC, or the like) inserted in the insulating housing is pulled in a direction different from the original insertion/removal direction, the lock arm member may be elastically displaced toward a non-constant direction shifted from a specified moving direction by the non-constant external force, and the electrical connector may be damaged or broken, for example, the lock arm member may be plastically deformed.

SUMMARY OF THE INVENTION

Therefore, it is an object of the present invention to provide an electrical connector that well prevents the risks of damage and breakage such as plastic deformation of a lock arm member and can improve usage durability with a simple configuration.

In order to achieve the above described object, the present invention employs a configuration that has an insulating housing into/from which a signal transmission medium is inserted or removed, the electrical connector configured to retain or release the signal transmission medium when a latch lock claw supported by an elastically displaceable lock arm member carries out specified movement so as to be engaged with or detached from the signal transmission medium inserted in the insulating housing; wherein a lock-arm regulating part that regulates non-constant movement different from the specified movement of the latch lock claw is provided; and the lock-arm regulating part is disposed to be opposed to part of the lock arm member in two directions including an insertion/removal direction in which insertion or removal of the signal transmission medium is carried out and an insertion/removal orthogonal direction orthogonal thereto.

According to the present invention having such a configuration, when non-constant external force such as pulling force in a direction different from the original insertion/removal direction is applied to the signal transmission medium inserted in the insulating housing, part of the lock arm member elastically displaced in a non-constant direction by the non-constant external force abuts the lock-arm regulating part, thereby preventing non-constant movement of the latch lock claw.

Moreover, according to the present invention, it is desired that the lock-arm regulating part be formed by bending of part of an electrically-conductive shell attached so as to cover the insulating housing.

According to the present invention having such a configuration, the lock-arm regulating part is efficiently manufactured together with the electrically-conductive shell.

Moreover, according to the present invention, it is desired that bending of the lock-arm regulating part be carried out along a bending axis extending approximately in parallel with the insertion/removal direction; and part of the lock arm member abutting the lock-arm regulating part have an insertion/removal-direction abutting surface disposed to be opposed to an end face of the lock-arm regulating part in the extending direction of the bending axis.

In the present invention having such a configuration, when pulling force is applied to the signal transmission medium, the acting force the lock-arm regulating part receives from the lock arm member has a tendency that the component force in the insertion/removal direction becomes larger than the component force in the insertion/removal orthogonal direction. Therefore, the insertion/removal-direction abutting surface of the lock arm member is effectively received by the end face of the lock-arm regulating part having larger strength, the actual strength of the lock-arm regulating part is increased, and the lock-arm regulating part can be downsized.

Moreover, according to the present invention, it is desired that the latch lock claw be integrally formed with an extending-direction first-end-side part of the lock arm member; and a second-end-side part of the lock arm member be integrally continued to an unlock operating part that detaches the latch lock claw from the signal transmission medium.

According to the present invention having such a configuration, a series of members from the unlock operating part to the lock arm member and the latch lock claw are integrated. Therefore, efficient manufacturing can be carried out.

Moreover, in the present invention, it is desired that the latch lock claw have an arrangement relation that the position of the latch lock claw is shifted in the insertion/removal orthogonal direction with respect to a supporting point of a case in which the lock arm member is elastically displaced by removal of the signal transmission medium.

In the arrangement relation of the present invention having such a configuration, when non-constant force such as pulling force in a direction other than the original insertion/removal direction is applied to the signal transmission medium inserted in the insulating housing, the latch lock claw tries to carry out rotary movement with respect to the supporting point at which elastic displacement of the lock arm member is carried out. Also in this case, part of the lock arm member abuts the lock-arm regulating part, thereby preventing rotary movement of the latch lock claw and reducing the risks of damage and breakage of the electrical connector.

As described above, the electrical connector according to the present invention employs a configuration provided with the lock-arm regulating part that regulates non-constant movement different from the specified movement of the latch lock claw, which carries out the specified movement so as to be engaged with or detached from the signal transmission medium inserted in the insulating housing, and the lock-arm regulating part is disposed so as to be opposed to the lock arm member in the two directions including the insertion/removal direction of the signal transmission medium and the insertion/removal orthogonal direction. Therefore, when non-constant external force such as pulling force in a direction different from the original insertion/removal direction is applied to the signal transmission medium inserted in the insulating housing, part of the lock arm member is configured to abut the lock-arm regulating part and prevent non-constant movement of the latch lock claw. Therefore, with the simple configuration, the risks of damage and breakage such as plastic deformation of the lock arm member can be well prevented, and usage durability of the electrical connector can be significantly improved at low cost.

DETAILED DESCRIPTION OF THE PREFERRED EMBODIMENT

Hereinafter, an embodiment in which the present invention is applied to an electrical connector, which is used by being mounted on a wiring board in order to establish electrical connection of a signal transmission medium comprised of a flexible printed circuit (FPC), a flexible flat cable (FFC), or the like, will be explained in detail based on drawings.

[About Overall Configuration of Electrical Connector According to First Embodiment]

Figure 5:
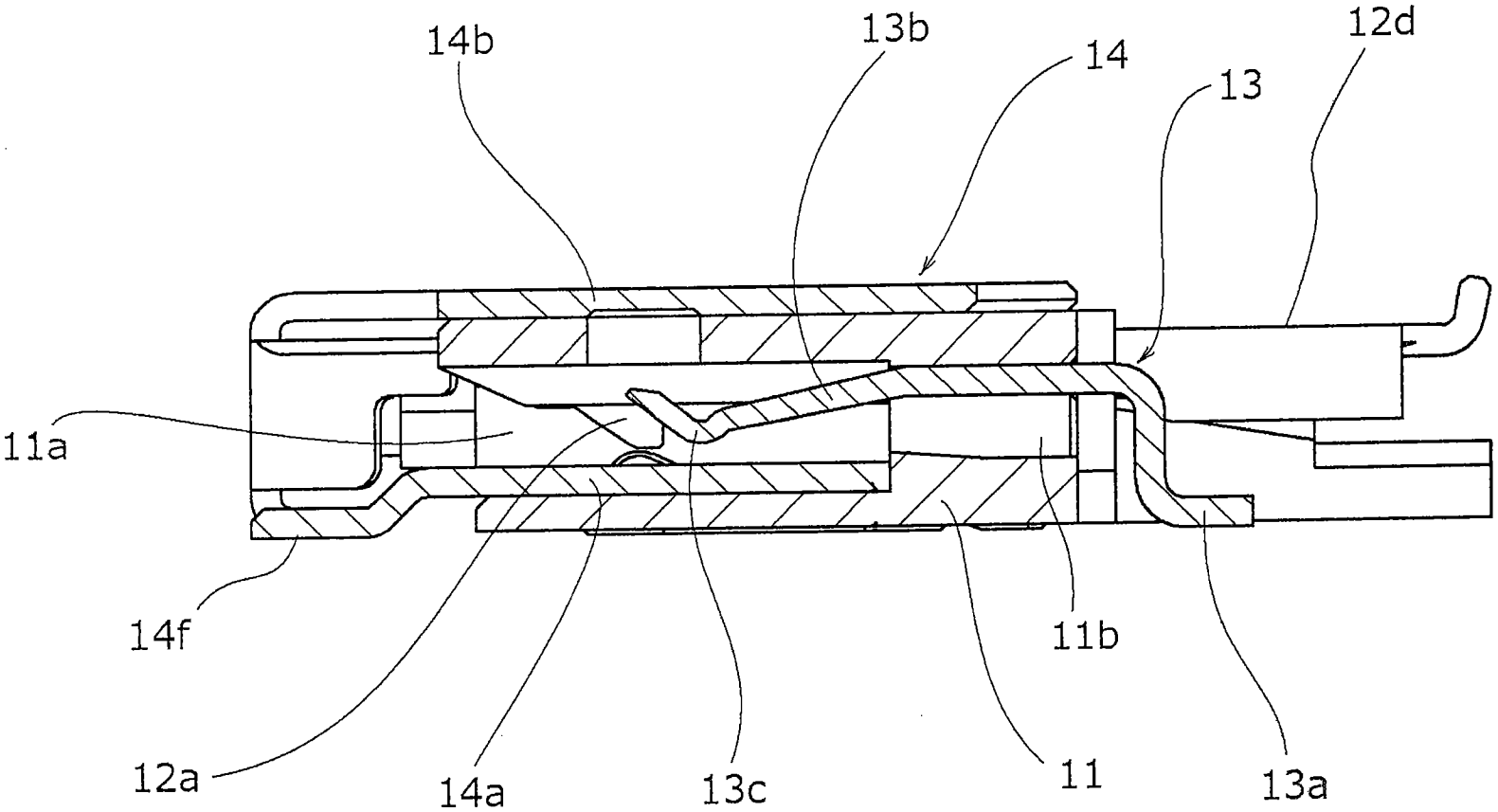
FIG. 5 is a transverse sectional explanatory drawing taken along a line V-V in FIG. 3.

An electrical connector 10 according to an embodiment of the present invention shown in FIG. 1 to FIG. 13 is comprised of an electrical connector of a NON-ZIF type provided with a so-called one-action auto-lock mechanism and is configured to automatically lock the signal transmission medium F when a terminal part of the above described signal transmission medium (FPC, FFC, or the like) F is inserted to a predetermined position in an insulating housing 11 through a medium insertion opening 11*a* provided at a front edge part (left edge part in FIG. 5) of the insulating housing 11.

[About Insulating Housing]

The above described insulating housing 11 is formed of an insulating member having a hollow frame shape extended to form a thin long shape, and a medium insertion path for inserting the signal transmission medium (FPC, FFC, or the like) F is formed in a hollow inner part of the insulating housing 11. The longitudinal width direction of the insulating housing 11 will be hereinafter referred to as "connector longitudinal direction", and the direction in which insertion or removal of the signal transmission medium (FPC, FFC, or the like) F is carried out will be referred to as "connector front-rear direction" or "medium insertion/removal direction".

At the front edge part (left edge part in FIG. 3) of the insulating housing 11, the medium insertion opening 11*a* into which the terminal part of the signal transmission medium F comprised of a flexible printed circuit (FPC), a flexible flat cable (FFC), or the like as described above is provided to form a thin long shape along the connector longitudinal direction. At the connector-longitudinal-direction both-end parts of the insulating housing 11, which are both-side outer parts of the medium insertion opening 11*a*, lock mechanisms 12 provided with latch lock claws 12*a*, which are engaged with the signal transmission medium (FPC, FFC, or the like) F inserted in the insulating housing 11 are disposed. Furthermore, at rear-end-side parts (right edge parts in FIG. 5) of the insulating housing 11, in other words, at opposite-side parts in the connector front-rear direction of the above described medium insertion opening 11*a*, a plurality of part attachment openings 11*b* for attaching electrically-conductive contacts (electrically-conductive terminals) 13, etc. in the insulating housing 11 are provided with predetermined intervals therebetween along the connector longitudinal direction.

[About Electrically-Conductive Shell]

Figure 12:
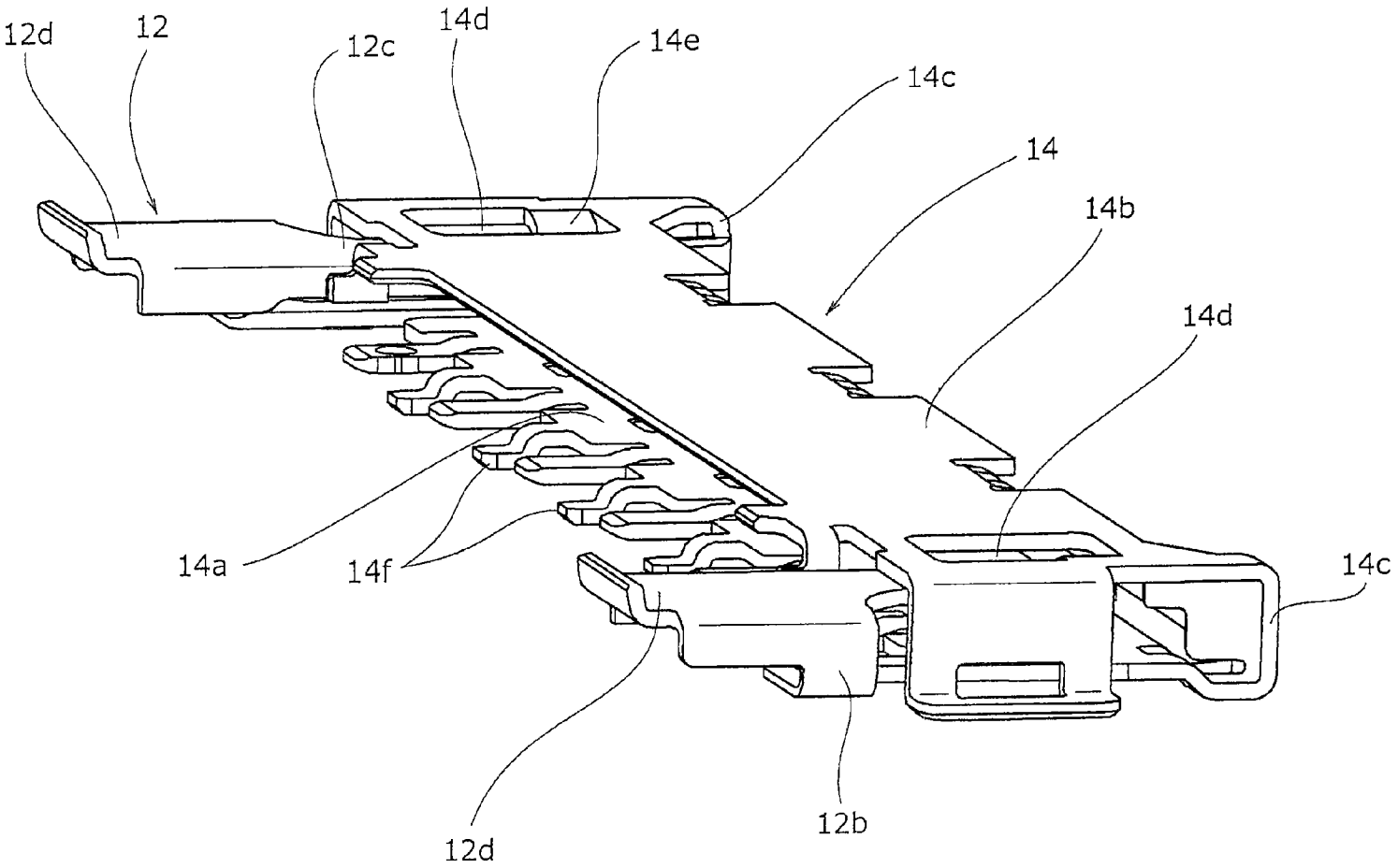
FIG. 12 is an external perspective view explanatory drawing showing, from a planar side, a single electrically-conductive shell used in the electrical connector according to the first embodiment of the present invention.
Figure 13:
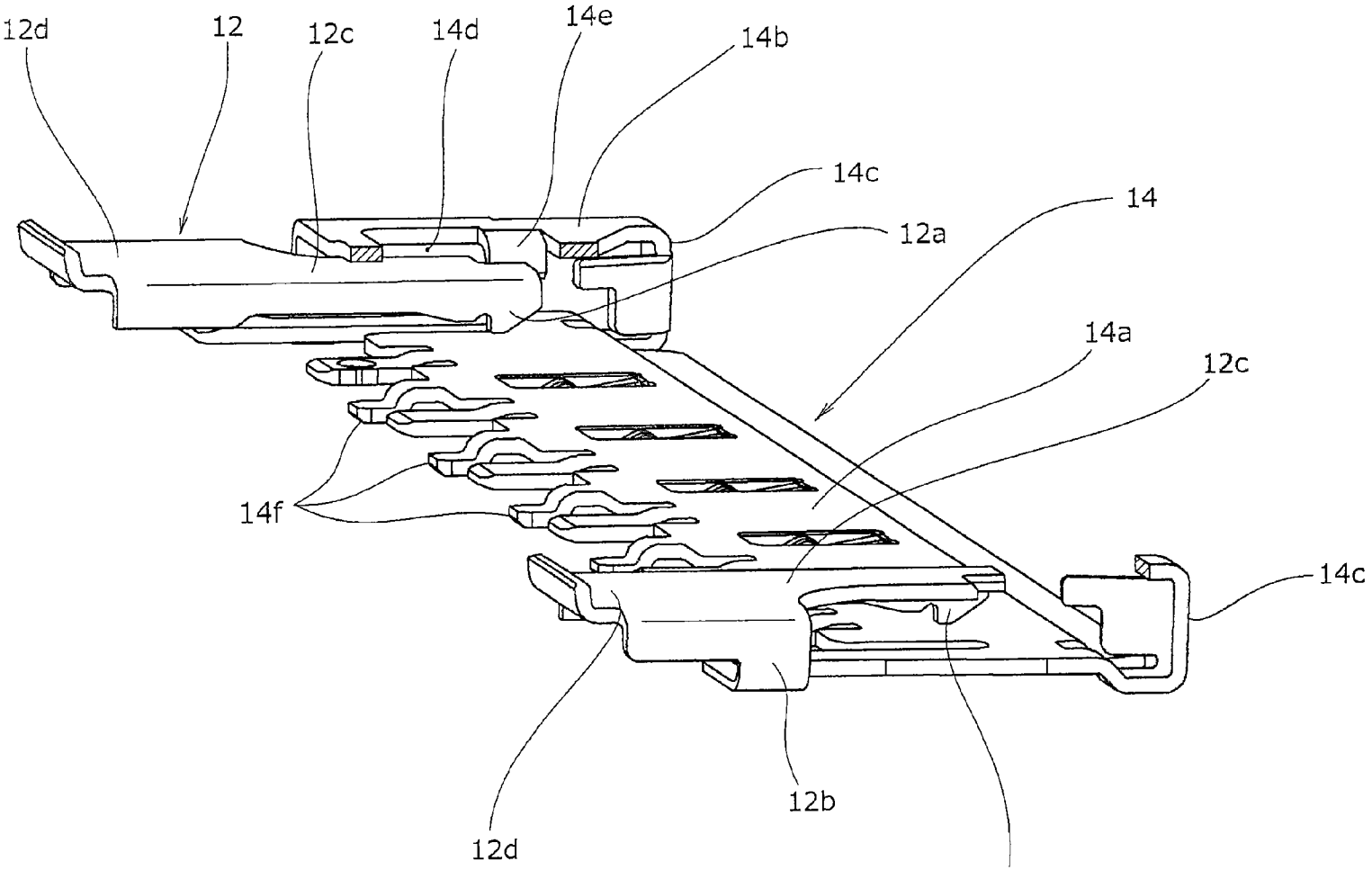
FIG. 13 is an external perspective explanatory drawing showing a state in which an upper-surface-side member is removed from the electrically-conductive shell shown in FIG. 12.

An electrically-conductive shell 14 is attached to the above described insulating housing 11 so as to cover the almost entire outer surface thereof except the medium insertion opening 11*a* and the part attachment openings 11*b*. Particularly as shown in FIG. 12 and FIG. 13, the electrically-conductive shell 14 is comprised of a thin-plate-shaped metal member formed by appropriate bending, has a shell bottom surface plate 14*a* having a flat plate shape placed on a main wiring board (illustration omitted), and has a shell upper surface plate 14*b*, which faces thereto approximately in parallel to form a predetermined interval therebetween at a position above the shell bottom surface plate 14*a*. The shell upper surface plate 14*b* has a structure which is integrally coupled via a shell coupling plate 14*c* formed so as to be raised from longitudinal-direction both-side parts of the front edge of the above described shell bottom surface plate 14*a*.

The shell bottom surface plate 14*a* and the shell upper surface plate 14*b* constituting the electrically-conductive shell 14 in this manner is attached, for example, by press-fitting to the above described insulating housing 11, and a plurality of board connecting parts 14*f* formed on the shell bottom surface plate 14*a* are solder-joined with shielded electrically-conductive paths (wiring pattern) on the main wiring board (illustration omitted).

At the connector-longitudinal-direction both-side end parts of the electrically-conductive shell 14 formed in this manner, the lock mechanisms 12 including the above described latch lock claws 12*a* are integrally formed. The lock mechanisms 12 in the present embodiment form so-called one-action auto-lock mechanisms as described above, and detailed configurations thereof will be explained in detail later.

[About Electrically-Conductive Contact]

The electrically-conductive contacts 13 are formed of thin-plate-shaped metal members formed by appropriate punching, the plurality of electrically-conductive contacts 13 are inserted from the part attachment openings 11*b*, which are in the rear end side of the above described insulating housing 11, toward the front side (left side in FIG. 5), and the plurality of electrically-conductive contacts 13 are disposed to be multipolar and form appropriate intervals therebetween in the connector longitudinal direction in the medium insertion path of the insulating housing 11. Each of the electrically-conductive contacts 13 is for signal transmission or ground connection and is used in a state that it is mounted by solder-joint with the electrically-conductive path formed on the main printed wiring board (illustration omitted).

Thus, signal-transmission electrically-conductive paths (signal-line pads) or shielded electrically-conductive paths (shielded line pads) are formed at appropriate pitch intervals on the signal transmission medium (FPC, FFC, or the like) F, which is inserted into the insulating housing 11 through the medium insertion opening 11*a*, and the disposed positions of the electrically-conductive contacts 13 attached in the insulating housing 11 in the above described manner are set to correspond to the wiring pattern of the signal transmission medium (FPC, FFC, or the like) F.

The configuration of the electrically-conductive contacts 13 according to the present embodiment will be explained in further detail. The electrically-conductive contacts 13 are formed so as to extend along the connector front-rear direction (medium insertion/removal direction), which is the insertion/detachment direction (left-right direction in FIG. 5) of the signal transmission medium (FPC, FFC, or the like) F, and the parts projecting from the connector rear end parts of the insulating housing 11 toward the rear side serve as board connecting parts 13*a*, which are solder-joined with the signal-transmission electrically-conductive paths (signal-line pads) formed on the main printed wiring board (illustration omitted). Each of the board connecting parts 13*a* is approximately perpendicularly bent and raised upward from the board connecting part 13*a*, is then approximately perpendicularly bent again in the horizontal direction, and is continued to the base part of a flexible arm part 13*b* comprised of a narrow-long-shaped beam member extending toward the front side.

The flexible arm part 13*b* at this point is extending from the part continued to the above described board connecting part 13*a* so as to form a cantilever structure along an upper inner wall surface of the medium insertion path of the insulating housing 11 and is configured to project obliquely downward toward the front side from an intermediate part thereof. The flexible arm part 13*b* of the electrically-conductive contact 13 having such a configuration has a structure that is swung in the top-bottom direction in the paper surface of FIG. 5 about the part, at which the board connecting part 13*a* is raised from the main printed wiring board (illustration omitted), or a vicinity thereof.

At a front-side extended part (left-end-side part in FIG. 5) of the flexible arm part 13*b*, a terminal contact projecting part 13*c* is provided so as to form a downward projecting shape in the drawing to correspond to the signal-transmission electrically-conductive path or the shielded electrically-conductive path (wiring pattern) formed on the signal transmission medium (FPC, FFC, or the like) F. Thus, the terminal contact projecting part 13*c* provided in the electrically-conductive contact 13 has an arrangement relation that, when the signal transmission medium F is inserted in the medium insertion path of the insulating housing 11 in the above described manner, the terminal contact projecting part 13*c* is placed over the wiring pattern provided on the signal transmission medium F. The signal transmission medium F is inserted to a predetermined final position in a state in which the terminal contact projecting part 13*c* is in contact therewith with a downward pressure of the elastic force of the flexible arm part 13*b*, wherein an electrically connected state therebetween is configured to be maintained.

[About One-Action Auto-Lock Mechanism]

Figure 1:
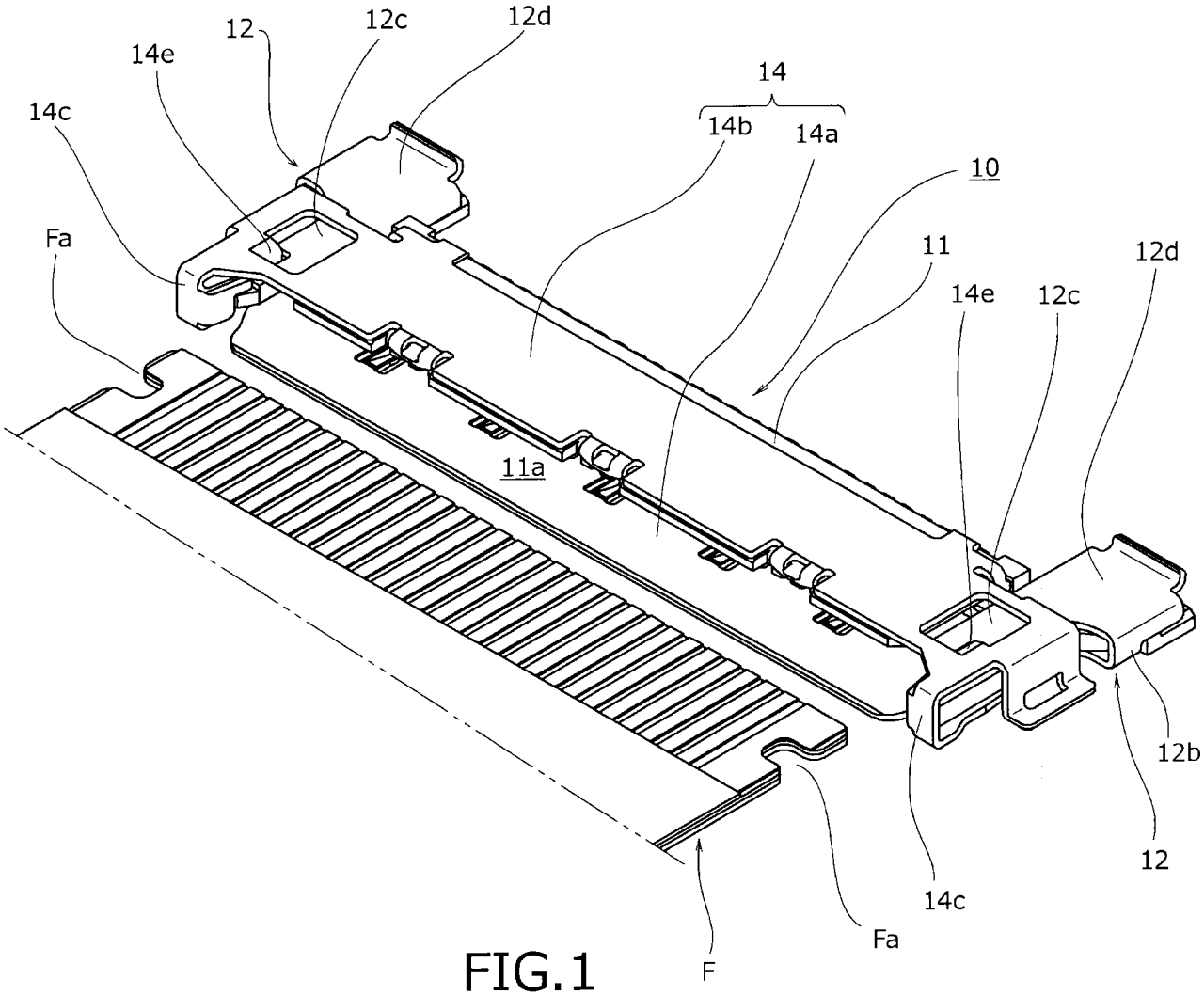
FIG. 1 is an external perspective explanatory drawing showing, from the front side, a state immediately before a signal transmission medium such as FPC or FFC is inserted in an electrical connector according to a first embodiment of the present invention.
Figure 2:
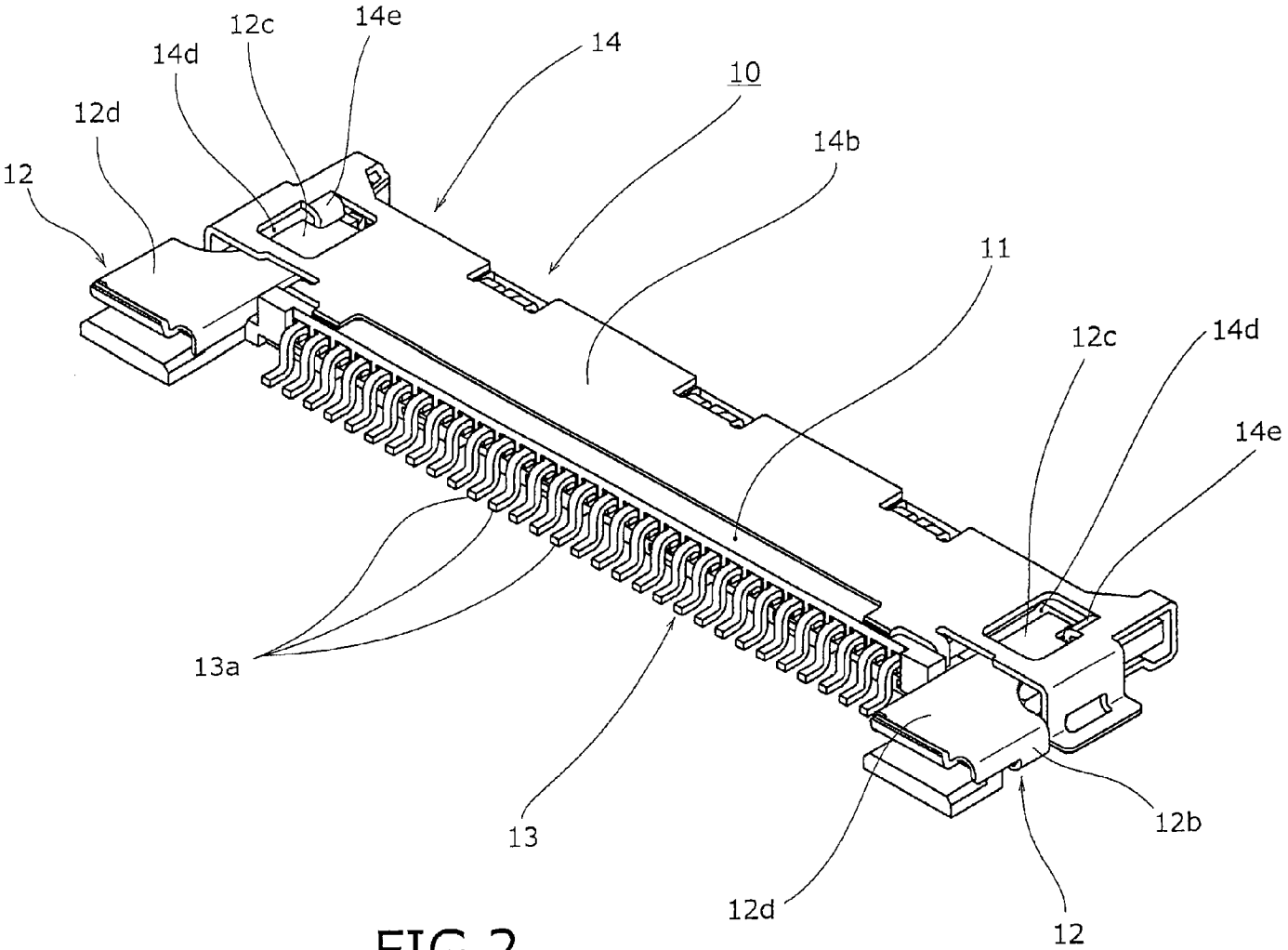
FIG. 2 is an external perspective explanatory drawing showing, from the back side, the electrical connector shown in FIG. 1.
Figure 3:
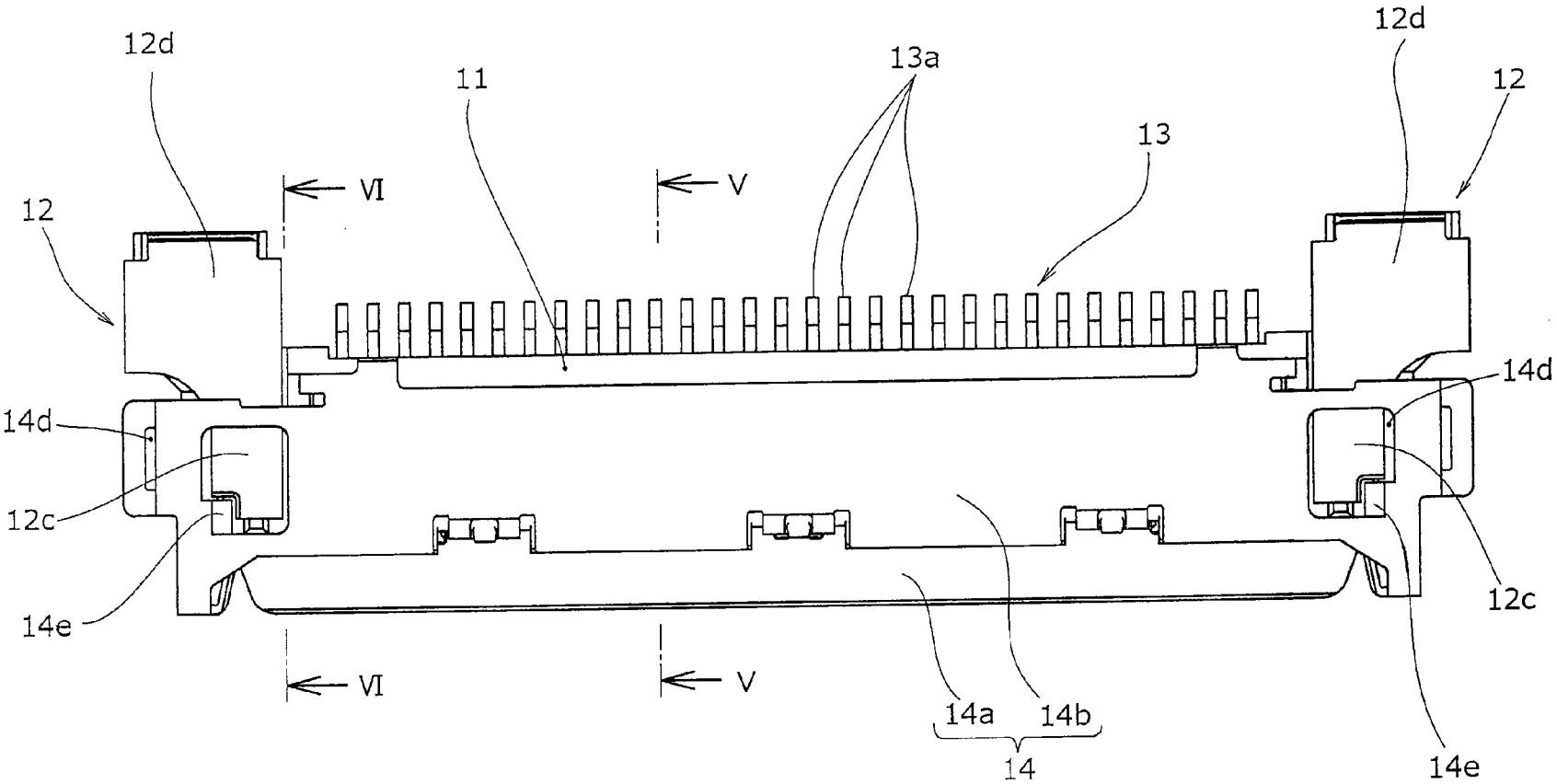
FIG. 3 is a plan explanatory drawing of the electrical connector shown in FIG. 1 and FIG. 2.
Figure 4:
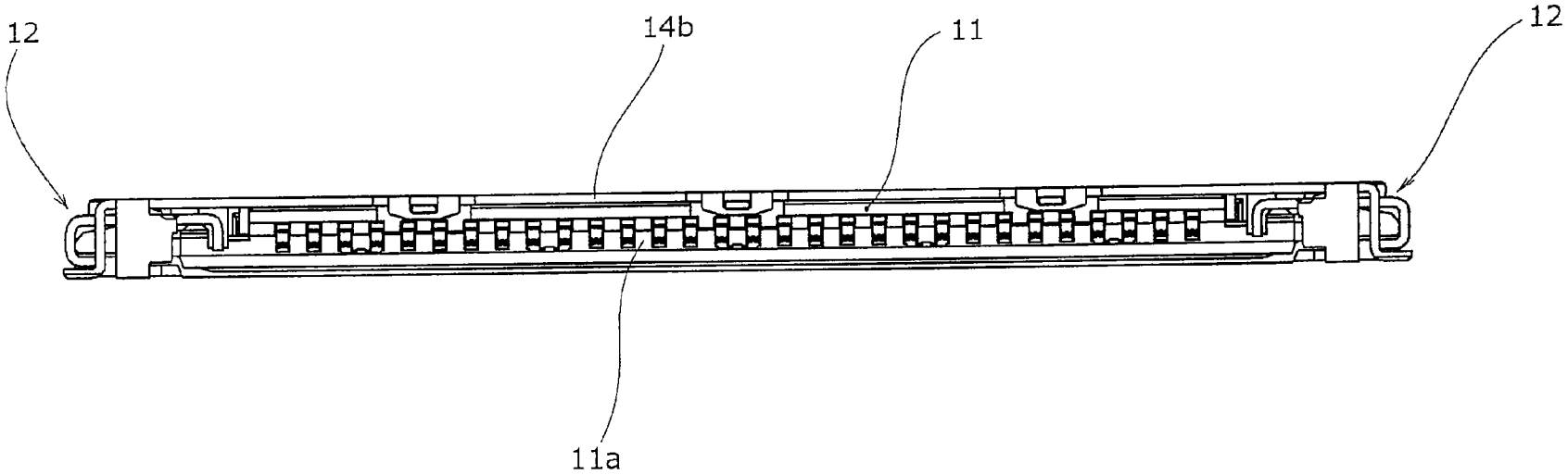
FIG. 4 is a front explanatory drawing of the electrical connector shown in FIG. 1 and FIG. 2.

The lock mechanisms 12 provided in the electrical connector 10 according to the present embodiment form the one-action auto-lock mechanisms as described above. As a condition thereof, engagement position determining parts Fa, Fa comprised of cut-away recessed parts are formed at width-direction both-side edge parts of the terminal part of the signal transmission medium (FPC, FFC, or the like) F particularly as shown in FIG. 1. The pair of latch lock claws 12*a*, 12*a* constituting the lock mechanisms 12 of the electrical connector 10 side are engaged with the engagement position determining parts Fa, Fa provided in the signal transmission medium F as if they are dropped from the upper side. The latching action (locking action) in this process retains the signal transmission medium F in a final inserted state without being removed.

[About the Latch Lock Claws]

Figure 10:
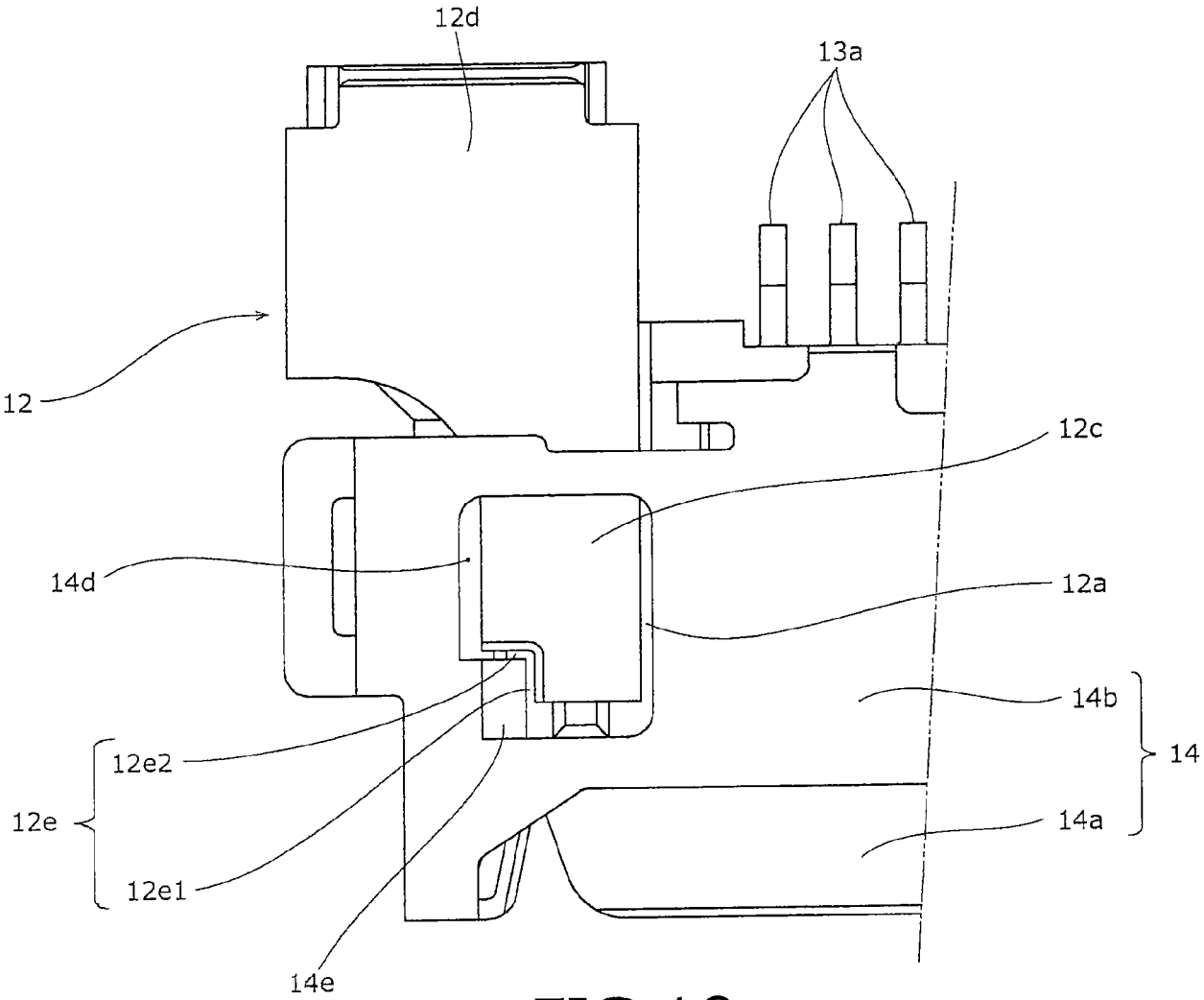
FIG. 10 is a partial planar explanatory drawing showing a lock mechanism provided at a longitudinal-direction one-side end part of the electrical connector shown in FIG. 3.
Figure 11:
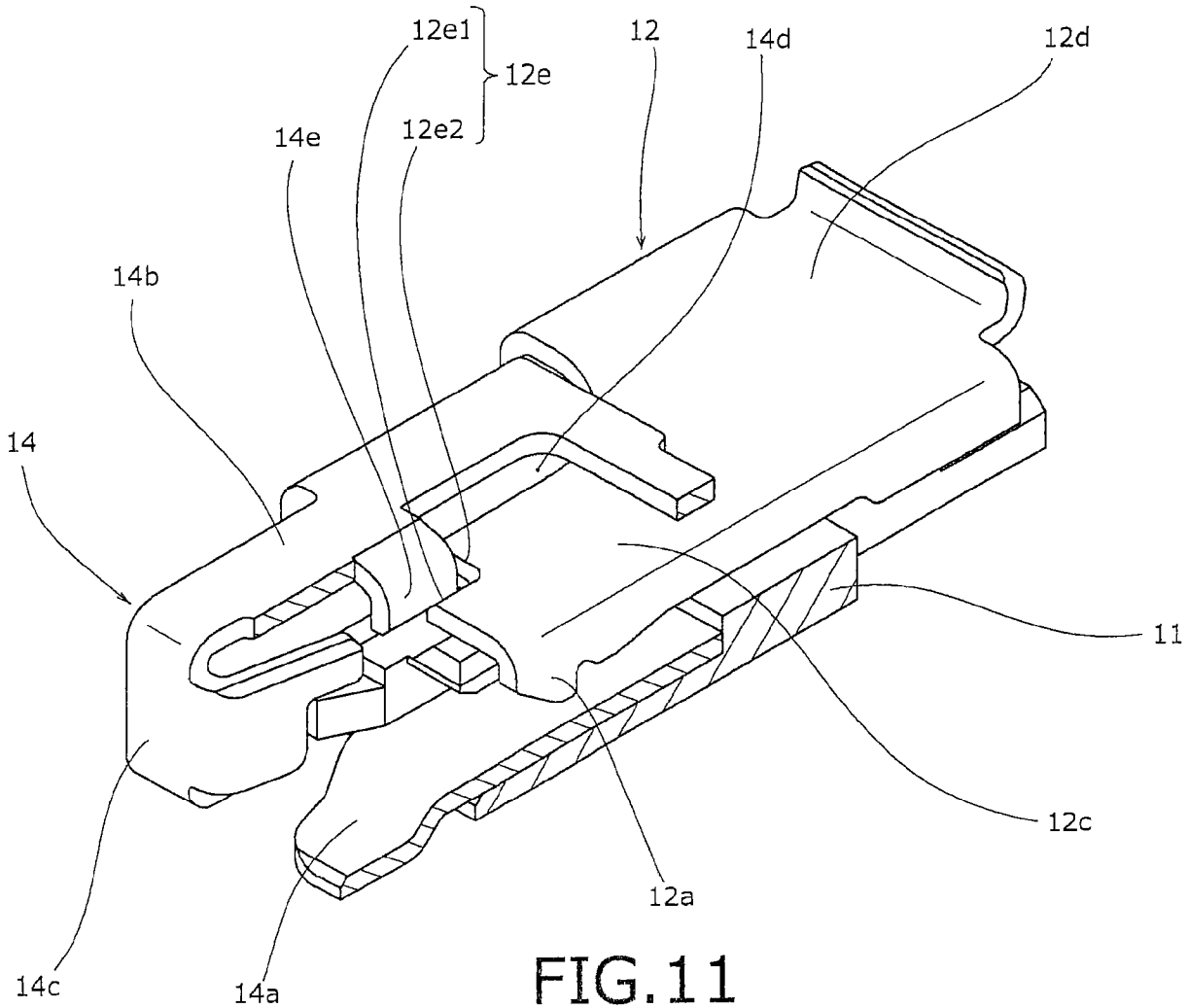
FIG. 11 is a cross-sectional perspective explanatory drawing showing a structure of the lock mechanism shown in FIG. 10.

Each of the lock mechanisms 12 including the latch lock claw 12*a* of this case is formed of a bent structure of an integrated thin-plate metal member particularly as shown in FIG. 10 and FIG. 11, and the lock mechanisms 12 are integrally provided at the connector-longitudinal-direction both end parts so as to form part of the electrically-conductive shell 14 as described above. At the connector-longitudinal-direction both end parts, the lock mechanisms 12 are integrally coupled to the electrically-conductive shell 14 via lock coupling plates 12*b* to the shell bottom surface plate 14*a* of the above described electrically-conductive shell 14.

The above described lock coupling plates 12*b* are comprised of plate-shaped pieces formed by bending so as to be extended upward approximately perpendicularly from rear end parts of the connector-longitudinal-direction both-side edges of the shell bottom surface plate 14*a*, and lock arm members 12*c* are extended approximately horizontally so as to form cantilever shapes from upper ends of the lock coupling plates 12*b* toward the front side (lower side in FIG. 10). Moreover, from upper end parts of the lock coupling plates 12*b*, unlock operating parts 12*d* are extended so as to form cantilever shapes approximately horizontally toward the rear (upper side in FIG. 10).

The lock arm parts 12*c* and the unlock operating parts 12*d* are formed of plate-shaped members integrally continued via the lock coupling plates 12*b*, and each of the lock arm parts 12*c* and the unlock operating parts 12*d* is configured to be swung in the vertical direction about the lock coupling plate 12*b* or a swing supporting point in the vicinity thereof. Therein, in extending-direction front end part of the lock arm parts 12, the above described latch lock claws 12*a* are integrally provided.

The latch lock claw 12*a* is comprised of a hook-shaped member formed by bending so that a plate-width-direction (connector longitudinal direction) connector-inner-side edge part of the lock arm member 12*c* projects downward and is formed to have an approximately triangular shape in the lateral side thereof. The latch lock claw 12*a* has an inclined guiding side extended obliquely upward from a vertex part in the lower end side thereof toward the front side. Since the latch lock claw 12*a* having such a shape is supported by the lock arm member 12*c* so that it can be elastically displaced, the latch lock claw 12*a* is configured to be moved in the vertical direction along with swing of the lock arm member 12*c*.

When the signal transmission medium (FPC, FFC, or the like) is inserted in the electrical connector 10, the lower end parts of the latch lock claws 12*a* are placed on the surface of the signal transmission medium F, and, corresponding to that, the lock arm members 12*c* are elastically deformed to be warped upward, thereby obtaining a state in which the latch lock claws 12*a* are displaced to the upper side. Then, when the engagement position determining parts Fa of the signal transmission medium F reach the positions immediately below the latch lock claws 12*a*, the latch lock claws 12*a* are pushed down to be moved toward the inside of the engagement position determining parts Fa by elastic returning force of the lock arm members 12*c*, and, as a result, the latch lock claws 12*a* obtain an engaged state (locked state) with the engagement position determining parts Fa to cause the signal transmission medium F to be in a retained state.

At this point, the shell upper surface plate 14*b* of the electrically-conductive shell 14 is in an arrangement relation in which the shell upper surface plate 14*b* is extended approximately in parallel with the shell bottom surface plate 14*a* with a predetermined interval therebetween, and the connector-longitudinal-direction both end parts of the shell upper surface plate 14*b* are in an arrangement relation in which they are overlapped with the lock arm members 12*c* of the above described lock mechanisms 12 from the upper side in a non-contact state. At connector-longitudinal-direction both end parts of the shell upper surface plate 14*b*, shell through holes 14*d* having approximately rectangular shape in plane are formed to penetrate therethrough at the positions corresponding to the lock arm members 12*c*, and the front end parts of the lock arm members 12*c* are in a state exposed toward the upper side of the connector through the shell through holes 14*d*.

The inner peripheral edge that forms the shell through hole 14*d* provided in the shell upper surface plate 14*b* is formed so as to be approximately rectangular in plane, and lock-arm regulating parts 14*e*, which regulate non-constant movement of the above described latch lock claws 12*a*, are formed at front-side corner parts of the inner peripheral edges of the shell through holes 14*d*. Each of the lock-arm regulating parts 14*e* is provided at the position corresponding to connector-outer-side corner part among the front-side both corner parts of the shell through hole 14*d*, and the lock-arm regulating part 14*e* is formed by a plate-shaped member, which is the shell upper surface plate 14*b* positioned at the corner part caused to project by a predetermined length toward the inner side of the shell through hole 14*d*. In this manner, the lock-arm regulating part 14*e* is formed of a plate-shaped member, which is projecting by a predetermined length in the connector longitudinal direction from the connector-outer-side edge of the shell through hole 14*d* toward the inner side of the shell through hole 14*d*, and the inner-side extended part of the plate-shaped member constituting the lock-arm regulating part 14*e* is bent so as to be curved downward. The bending axis of the bent lock-arm regulating part 14*e* is set to extend in the direction that approximately matches the connector front-rear direction, which is the insertion/removal direction of the signal transmission medium (FPC, FFC, or the like) F.

In this case, the front end part of the above described lock arm member 12*c* has an arrangement relation in which it is close to the lock-arm regulating part 14*e*, and a cut-away abutting part 12*e* disposed to be close to the lock-arm regulating part 14*e* is provided at the front end part of the lock arm member 12*c*. The cut-away abutting part 12*e* is formed to cut away a connector-outer-side corner part among both corner parts of the front end part of the lock arm part 12*c*, in other words, cut away the corner part positioned in the opposite side of the above described latch lock claw 12*a* into an approximately rectangular shape in plane. Two sides constituting the approximately rectangular planar shape of the cut-away abutting part 12*e* have an arrangement relation that they are opposed to the two sides constituting the corner part of the above described lock-arm regulating part 14*e* from the connector inner side with appropriate intervals therebetween.

More specifically, one side among the two sides constituting the above described cut-away abutting part 12*e* is an insertion/removal orthogonal-direction abutting surface 12*e*1 which is approximately parallel to the bending axis of the bent lock-arm regulating part 14*e*, in other words, is extending in the insertion/removal direction (connector front-rear direction) of the signal transmission medium (FPC, FFC, or the like) F. The insertion/removal orthogonal-direction abutting surface 12*e*1 is disposed so as to be close to and opposed to a principal surface owned by the above described lock-arm regulating part 14*e* in the connector longitudinal direction. The other side among the two sides constituting the cut-away abutting part 12*e* is an insertion/removal-direction abutting surface 12*e*2 extending in the direction approximately orthogonal to the bending axis of the lock-arm regulating part 14*e*, and the insertion/removal-direction abutting surface 12*e*2 is disposed so as to be close to and opposed to a bending-axis-direction end face of the lock-arm regulating part 14*e* in the medium insertion/removal direction (connector front-rear direction).

In this case, the insertion/removal orthogonal-direction abutting surface 12*e*1 and the insertion/removal-direction abutting surface 12*e*2 constituting the cut-away abutting part 12*e* of the above described lock arm member 12*c* do not have a positional relation in which they abut the lock-arm regulating part 14*e*, which is provided in the electrically-conductive shell 14 side, in the vertical direction. Therefore, upon movement of the lock arm member 12*c* in the vertical direction, in other words, upon constant movement of the lock arm member 12*c* when the latch lock claw 12*a* is engaged with or detached from the engagement position determining part Fa, Fa of the signal transmission medium (FPC, FFC, or the like) F, constant movement of both of the insertion/removal orthogonal-direction abutting surface 12*e*1 and the insertion/removal-direction abutting surface 12*e*2 is allowed without abutting the lock-arm regulating part 14*e*. On the other hand, in the case of non-constant movement different from the constant movement of the lock arm part 12*c*, in other words, the case in which the lock arm part 12*c* includes a movement component in the connector longitudinal direction, the insertion/removal orthogonal-direction abutting surface 12*e*1 or the insertion-direction abutting surface 12*e*2 constituting the cut-away abutting part 12*e* of the lock arm part 12*c* abuts the lock-arm regulating part 14*e*, thereby preventing non-constant movement of the lock-arm member 12*c*.

On the other hand, the unlock operating part 12*d* also constituting the lock mechanism 12 is comprised of a plate-shaped member continued to the rear end part of the above described lock arm member 12*c* and is projecting toward the rear side from the shell upper surface plate 14*b* of the above described electrically-conductive shell 14. When a fingertip of an operator is placed on a flat-surface part of the unlock operating part 12*d* and pushes it downward, the latch lock claw 12*a* is configured to be elastically displaced to the upper side together with the above described lock arm member 12*c*.

At this point, at a position below the unlock operating part 12*d*, part of the bottom plate of the insulating housing 11 is disposed to face thereto and is configured to have a stopper function of a case in which the unlock operating part 12*d* is pushed downward.

Figure 6:
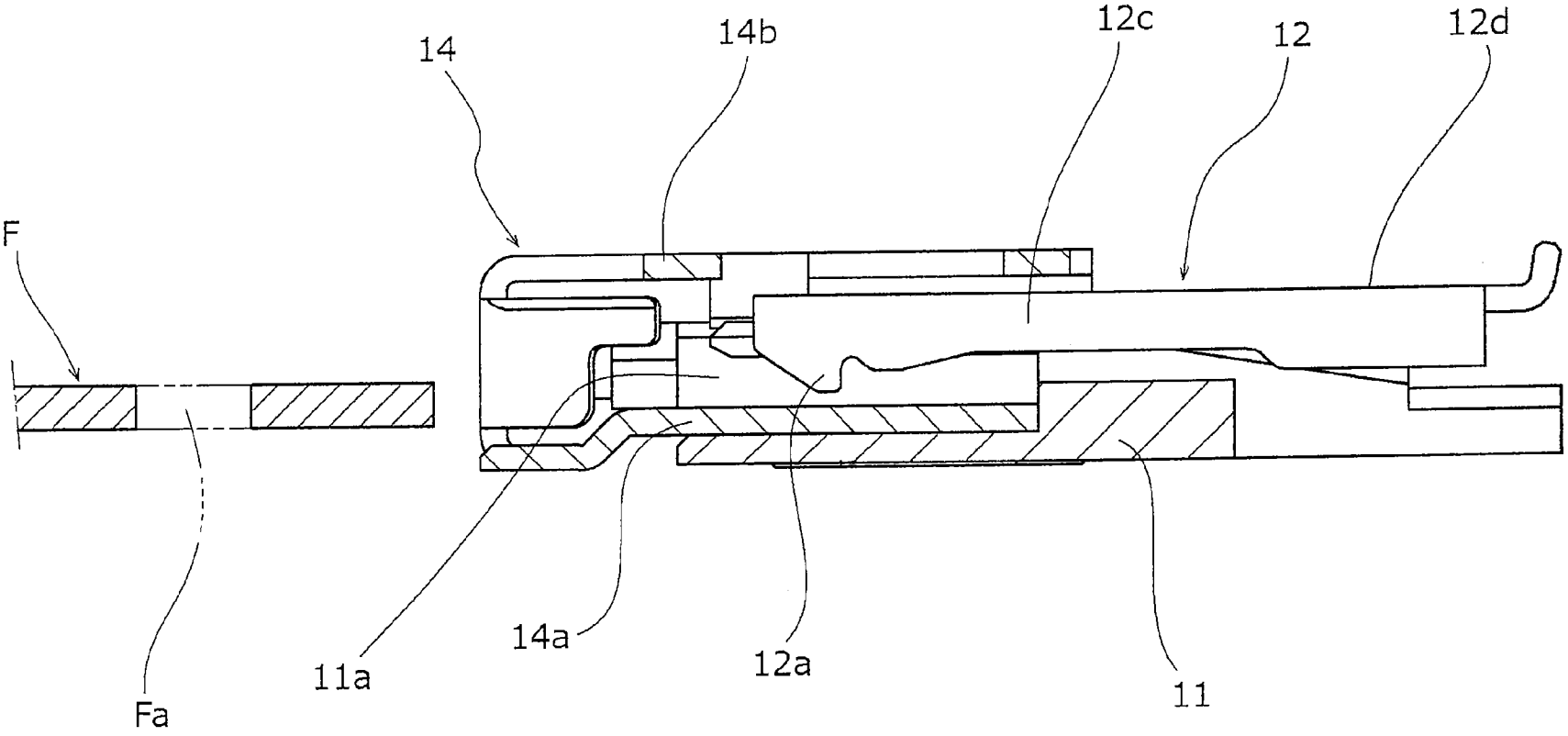
FIG. 6 is a transverse sectional explanatory drawing taken along a line VI-VI in FIG. 3 and showing a state immediately before the signal transmission medium is inserted in the electrical connector according to the first embodiment of the present invention.
Figure 7:
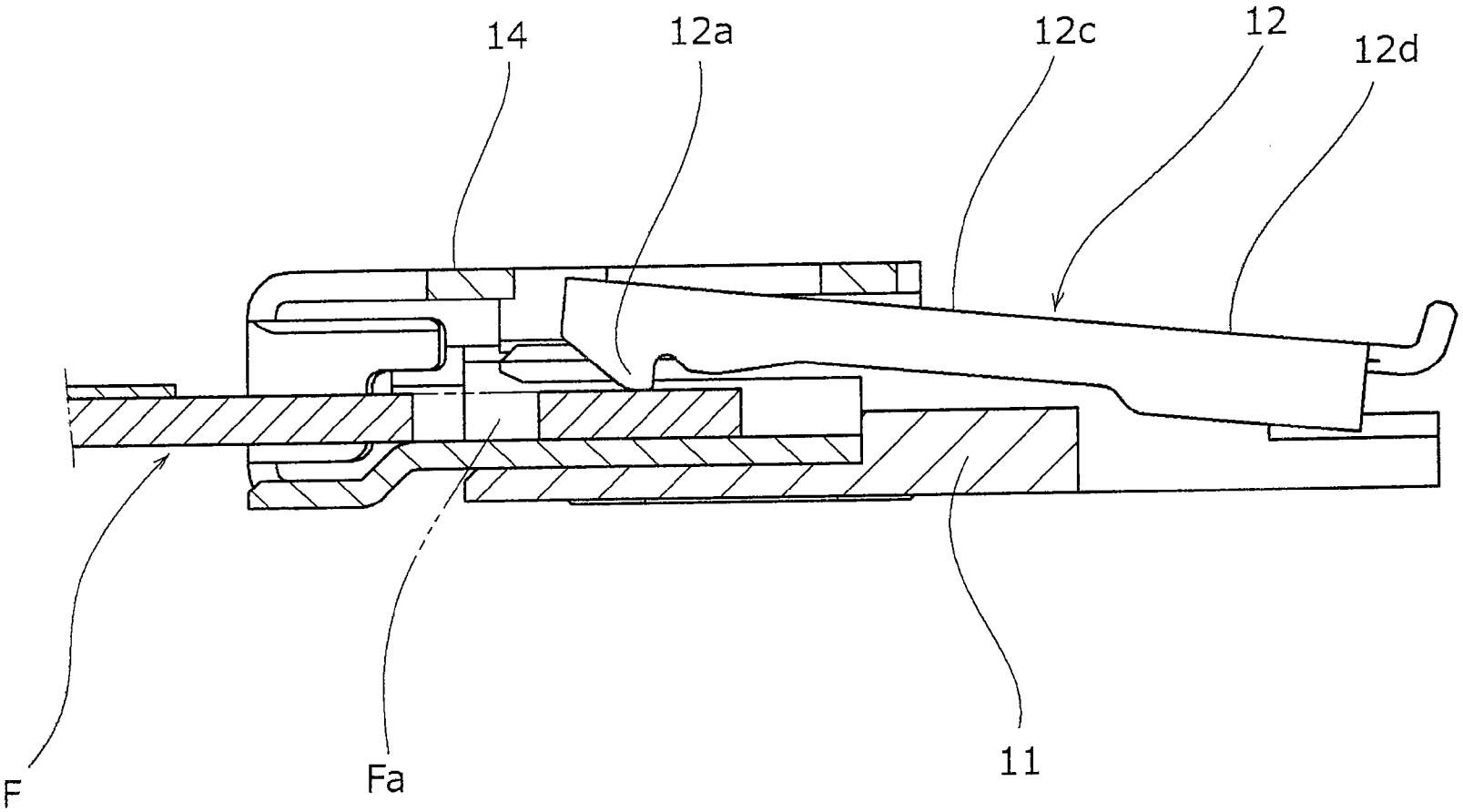
FIG. 7 is a transverse sectional explanatory drawing corresponding to FIG. 6 showing an intermediate stage of a process in which the signal transmission medium is inserted in the electrical connector according to the first embodiment of the present invention.
Figure 8:
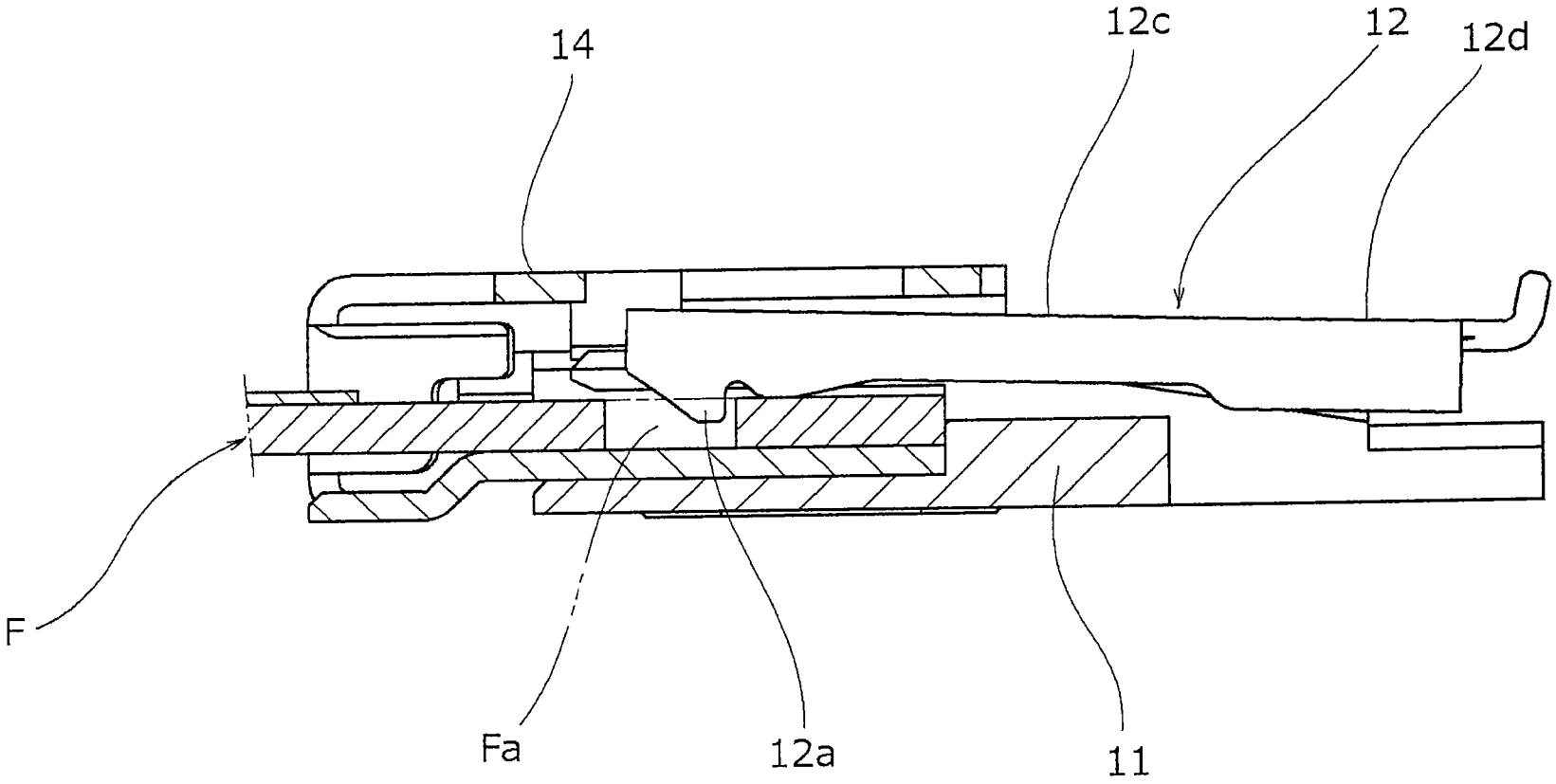
FIG. 8 is a transverse sectional explanatory drawing corresponding to FIG. 6 showing a state in which the signal transmission medium is further inserted and locked from the insertion intermediate stage of FIG. 7.

The state from insertion to engagement of the signal transmission medium (FPC, FFC, or the like) F will be explained in detail. First, as shown in FIG. 6 to FIG. 7, when the signal transmission medium F is inserted in the medium path of the insulating housing 11 through the medium insertion opening 11*a* of the insulating housing 11, the insertion-side distal edge part of the signal transmission medium F abuts the inclined guiding part of the latch lock claw 12*a*, and the latch lock claw 12*a* is placed on the surface of the signal transmission medium F. As a result, the lock arm member 12*c* supporting the latch lock claw 12 is elastically displaced so as to be pushed to the upper side about the lock coupling plate 12*b* or the swing supporting point in the vicinity thereof. The terminal part of the signal transmission medium F is further pushed in this state toward the rear side; and, then, when the engagement position determining part Fa of the signal transmission medium F is moved to the position immediately below the latch lock claw 12*a*, as shown in FIG. 8, the latch lock claw 12*a* is moved so as to be pushed into the engagement position determining part Fa of the signal transmission medium F by the elastic returning force of the lock arm member 12*c*. As a result, the latch lock claw 12*a* becomes an engaged state with the engagement position determining part Fa of the signal transmission medium F, and the signal transmission medium F is retained so that it is not removed therefrom.

Figure 9:
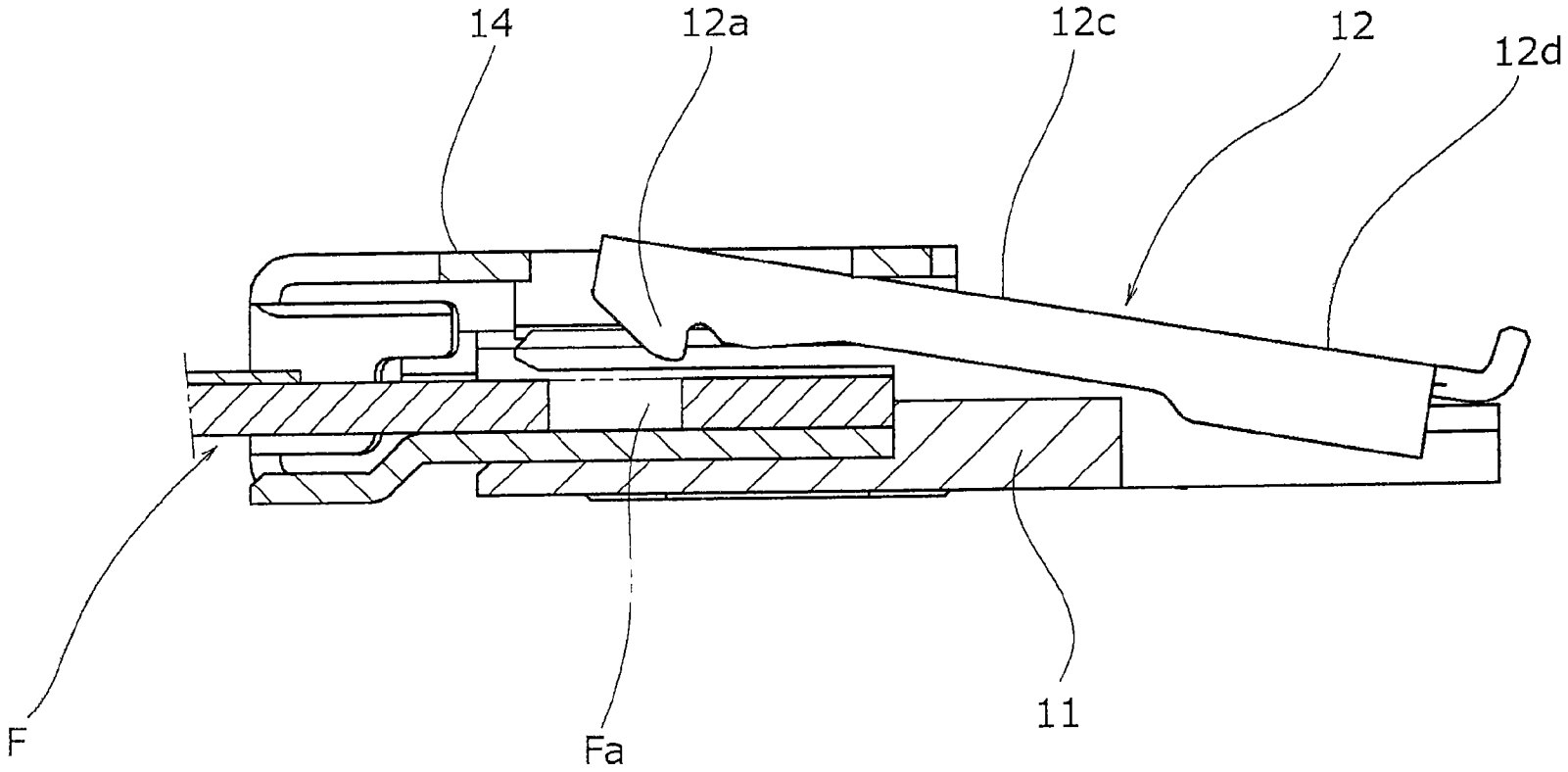
FIG. 9 is a transverse sectional explanatory drawing corresponding to FIG. 6 showing a state in which an unlocking operation is carried out in the locked state of FIG. 8.

On the other hand, when an unlocking operation in which the unlock operating part 12*d* is pushed down by the operator as shown in FIG. 9 is carried out in the state in which the latch lock part 12*a* is engaged with the engagement position determining part Fa of the signal transmission medium F, the latch lock claw 12*a* is moved to the upper side against the elastic force of the lock arm member 12*c*, the latch lock claw 12*a* is detached from the engagement position determining part Fa of the signal transmission medium F, and the engaged state (locked state) of the latch lock claw 12 is cancelled.

In the present embodiment having such a configuration, when non-constant external force such as pulling in a direction different from the original insertion/removal direction is applied to the signal transmission medium (FPC, FFC, or the like) F retained by the latch lock claw 12*a* by insertion into the insulating housing 11, the lock arm member 12*c* is also elastically displaced in a non-constant direction by the non-constant external force, and the insertion/removal orthogonal-direction abutting surface 12*e*1 or the insertion/removal-direction abutting surface 12*e*2 of the cut-away abutting part 12*e* provided at the front end part of the lock arm member 12*c* abuts the lock-arm regulating part 14*e*, thereby preventing non-constant movement of the lock arm member 12*c* and the latch lock claw 12*a* and reducing the risks of damage and breakage of the electrical connector 10.

When pulling force is applied to the signal transmission medium (FPC, FFC, or the like) F, the acting force the lock-arm regulating part 14*e* receives from the lock arm member 12*c* has a tendency that the component force in the insertion/removal direction becomes larger than the component force in the insertion/removal orthogonal direction. Regarding such a situation, in the present embodiment, the insertion/removal-direction abutting surface 12*e*2 constituting the cut-away abutting part 12*e* of the lock arm member 12*c* is disposed so as to face the bending-axis-direction end face of the lock-arm regulating part 14*e*. Thus, the insertion/removal-direction component force having larger acting force is configured to be received by the lock-arm regulating part 14*e* having larger strength; therefore, the actual strength of the lock-arm regulating part 14*e* is increased, and the lock-arm regulating part 14*e* can be downsized.

In this case, the lock-arm regulating part 14*e* according to the present embodiment is formed by bending part of the electrically-conductive shell 14. Therefore, the lock-arm regulating part 14*e* is configured to be efficiently manufactured together with the electrically-conductive shell 14.

Furthermore, in the present embodiment, the part from the latch lock claw 12*a* integrally formed with an extending-direction first-end-side part of the lock arm member 12*c* to the unlock operating part 12*d* provided at a second-end-side part of the lock arm member 12*c* is integrally continued, and the series of members from the unlock operating part 12*d* to the lock arm member 12*c* and the latch lock claw 12*a* are integrated; therefore, efficient manufacturing can be carried out.

Furthermore, in the present embodiment, with respect to the supporting point of the case in which the lock arm member 12*c* is elastically displaced by removal of the signal transmission medium (FPC, FFC, or the like) F, the latch lock claw 12*a* has an arrangement relation in which the position of the latch lock claw 12*a* is shifted in the insertion/removal orthogonal direction. Therefore, when non-constant external force is applied, for example, since the signal transmission medium (FPC, FFC, or the like) F is pulled in a direction different from the original insertion/removal direction, the latch lock claw 12*a* tries to carry out rotary movement with respect to the supporting point of the elastic displacement of the lock arm member 12*c*. However, also in this case, the insertion/removal orthogonal-direction abutting surface 12*e*1 or the insertion-direction abutting surface 12*e*2 constituting the cut-away abutting part 12*e* of the lock arm member 12*c* abuts the lock-arm regulating part 14*e*, thereby preventing the rotary movement of the latch lock claw 12*a* and reducing the risks of damage and breakage of the electrical connector.

Hereinabove, the invention accomplished by the present inventor has been explained in detail based on the embodiment. However, the present invention is not limited to the above described embodiment, and it goes without saying that various modifications can be made within a range not departing from the gist thereof.

For example, in the above described embodiment, the flexible printed circuit (FPC) and the flexible flat cable (FFC) are employed as the signal transmission medium fixed to the electrical connector. However, the present invention can be similarly applied also to a case in which other signal transmission media, etc. are used.

Furthermore, in the electrical connector according to the above described embodiment, the electrically-conductive contacts having the same shapes are used. However, the present invention can be similarly applied even to a structure in which electrically-conductive contacts having different shapes are alternately disposed.

The present invention can be widely applied to various electrical connectors used in various electrical devices.

What is claimed is:

1. An electrical connector comprising;

an insulating housing into/from which a signal transmission medium is inserted or removed, the electrical connector configured to retain or release the signal transmission medium when a latch lock claw supported by an elastically displaceable lock arm member carries out specified movement so as to be engaged with or detached from both side edges in the width direction of the signal transmission medium inserted in the insulating housing; wherein a lock-arm regulating part that regulates non-constant movement different from the specified movement of the latch lock claw is provided; and the lock-arm regulating part is disposed to be opposed to an insertion/removal-direction abutting surface and an insertion/removal orthogonal-direction abutting surface which are formed by a cut away part of the lock arm member in two directions including an insertion/removal direction in which insertion or removal of the signal transmission medium is carried out and the width direction of the signal transmission medium that is an insertion/removal orthogonal direction orthogonal thereto.

2. The electrical connector according to claim 1, wherein the lock-arm regulating part is formed by bending of part of an electrically-conductive shell attached so as to cover the insulating housing.

3. The electrical connector according to claim 2, wherein bending of the lock-arm regulating part is carried out along a bending axis extending approximately in parallel with the insertion/removal direction; and the insertion/removal-direction abutting surface disposed to be opposed to an end face of the lock-arm regulating part in the extending direction of the bending axis.

4. The electrical connector according to claim 1, wherein the latch lock claw is integrally formed with an extending-direction first-end-side part of the lock arm member; and a second-end-side part of the lock arm member is integrally continued to an unlock operating part that detaches the latch lock claw from the signal transmission medium.

5. The electrical connector according to claim 1, wherein the latch lock claw has an arrangement relation that the position of the latch lock claw is shifted in the insertion/removal orthogonal direction with respect to a supporting point of a case in which the lock arm member is elastically displaced by removal of the signal transmission medium.

* * * * *